United States Patent [19]

Schloss

[11] Patent Number: 4,846,362

[45] Date of Patent: Jul. 11, 1989

[54] POLYETHYLENE CLOSURE WITH REMOVABLE LINER

[75] Inventor: Francis M. Schloss, Perrysburg, Ohio

[73] Assignee: Owens-Illinois Closure Inc., Toledo, Ohio

[21] Appl. No.: 164,285

[22] Filed: Mar. 4, 1988

[51] Int. Cl.[4] ..... B65D 53/04

[52] U.S. Cl. ..... 215/349; 264/268

[58] Field of Search ..... 215/349, 341, 347; 264/268

[56] References Cited

U.S. PATENT DOCUMENTS

| | | | |
|---|---|---|---|
| 2,072,536 | 3/1937 | Trickey et al. | 264/268 X |
| 2,131,319 | 9/1938 | Greenholtz et al. | 264/268 |
| 3,866,845 | 2/1975 | Keeler et al. | 215/341 |
| 4,497,765 | 2/1985 | Wilde et al. | 264/268 |

*Primary Examiner*—Donald F. Norton

[57] ABSTRACT

A polyethylene compression-molded closure with an elastomer liner that is removable, the elastomer being a blend of polypropylene and a rubbery copolymer.

8 Claims, 1 Drawing Sheet

POLYETHYLENE CLOSURE WITH REMOVABLE LINER

The present invention relates to a polyethylene closure having a top and having a compressioned molded plastic liner on the inside of the closure top.

BACKGROUND OF THE INVENTION

In the past, polyethylene closures have been made with a compression-molded liner on the inside of the closure top. It is desirable to have a liner that is removable for some applications. However such liners were not removable and removal efforts resulted in tearing and destruction of the liner material. Apparently, the polyethylene of the closures and the liner material fused and formed a strong bond from the heat and pressure of the compression molding operation.

It is highly desirble to have a good efficient liner that can be easily removed for some applications.

OBJECTS OF THE INVENTION

It is an object of the present invention to provide a polypropylene based thermoplastic elastomer material (blend of polypropylene and a rubber copolymer and containing a mineral oil or petroleum oil) that can be compression molded into a polyethylene closure on the inside top of the closure, the liner having little adhesion to the closure and being easily removable thereform.

It is an object of the present invention to provide a polyethylene closure with a top and a depending skirt, a liner for the inside of the top that is compression molded with the closure, the liner being removable without tearing, the liner being a blend of (a) polypropylene, (b) a thermoplastic elastomer that is a copolymer of styrene and a copolymerizable monomer and (c) a mineral oil or petroleum oil.

These and other objects will be apparent from the specification that follows, the appended claims, and the drawings, in which:

FIG. 1 is a perspective view of a compression molded polyethylene closure and compression molded elastomeric liner, the liner being shown removed from the inside top of the closure, without damage.

SUMMARY OF THE INVENTION

The present invention provides a closure assembly including a polyethylene closure or cap with a removable elastomeric liner that is a blend of polypropylene and a rubbery copolymer of styrene and another copolymerizable monomer such as butadiene.

The present invention also provides a method of making a polyethylene closure cap with a removable lining, the closure having a top closure wall with an inner and outer wall, the method comprising: compression molding a liner on the inner wall of the closure top, the liner being removable, elastomeric, and being a blend of polypropylene and a copolymer of styrene and a copolymerizable monomer.

DETAILED DESCRIPTION OF THE INVENTION

Figure 1:
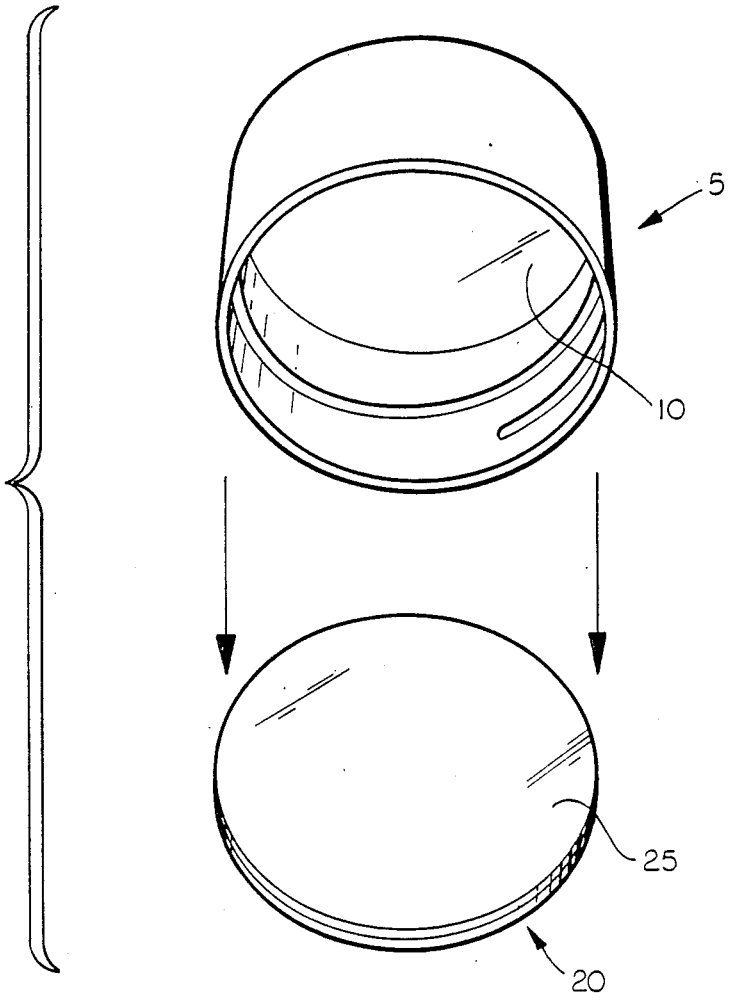

In the drawings, a compression molded polyethylene closure or cap 5 is shown, the closure having an inside top surface 10. An elastomeric liner 20 is provided, the liner having a surface 25 that is adjacent the closure top surface 10 in the assembled position. The liner 20 is removable, without damage, as shown in FIG. 1.

The polyethylene closure is preferably compression molded with an elastomeric liner that is blend of generally about 20 to 60 wt. % and preferably about 30 to 50 wt. % polypropylene and generally about 40 to 50 wt. % and preferably 50 to 70 wt. % of the rubbery copolymer. The copolymer blend generally contains about 20 to 50 wt. % mineral or petroleum oil.

The best results are obtained generally when the blend, exclusive of oil, is about 40 wt. % polypropylene and a 60 wt. % copolymer. As to the oil, about 40 wt. % of the blend provides the best results.

The copolymerizable monomer for the styrene of the elastomer of the blend is preferably butadiene, although isoprene and ethylene butylene can be used to provide benefits of the invention. The rubbery copolymer can be a copolymer of ethylene and propylene.

The elastomeric copolymer is preferably a block copolymer of styrene and butadiene or hydrogenated butadiene or ethylene butylene. A suitable block copolymer is a copolymer material Kraton-G TM sold by Shell.

A suitable block copolymer is one of styrene and butadiene, for instance, prepared by anionic polymerization. The copolymers are thermoplastic rubbers, showing the behavior of vulcanized elastomers at room temperature with hard chain length blocks of styrene acting similarly to crosslinks to prevent creep in the polybutadiene block matrix. At higher temperatures, they undergo normal plastic flow.

The butadiene component of the copolymer can be replaced by isoprene or ethylene butylene as, for instance, is available as Kraton ® rubber materials including 1102 and 1107 from Shell Chemical.

Stereon 840A and other Stereon ® elastomers, available from Firestone, Akron, Ohio, are suitable butadienestyrene block copolymer elastomers, the block copolymer containing about 35 to 55 wt. % bound styrene and having a number average molecular weight of about 50,000 to 100,000. Stereon 840A brochures list two of the block copolymers having 53 and 43 wt. bound styrene and number average molecular weight about 60,000 to 80,000.

In the present invention, the compression molding is done in an apparatus similar to that shown in H-C Industries, Inc. U.S. Pat. No. 4,497,765, this patent being incorporated herein by reference. In column 7, lines 42–48, a polypropylene compression-molding cap is disclosed and a compression-molded cap 12 is shown in FIGS. 1 and 2.

The compression-molded cap or closure is made and then the liner compression molded in the cap using similar compression molding equipment and techniques. The molded liner is generally about 2 to 5 mils up to 10 or 20 mils or more in thickness.

In the present invention, the elastomeric liner of the Teknor Apex experimental Telcar 86K982 (with polyethylene) stuck excessively to the polyethylene closure. In contrast to this, the Teknor Apex experimental Telcar 83F943DNT Grey 744 (with polypropylene) did not stick excessively to the polyethylene closure.

What is claimed is:

1. A polyethylene closure with a top and a depending skirt, a removable liner for the top of the closure that is compression molded into the closure, the liner being a blend of polypropylene and a thermoplastic elastomeric copolymer.

2. A closure as defined in claim 1 in which the copolymer is a block copolymer of styrene and butadiene; the blend also containing mineral oil or petroleum oil.

3. A closure as defined in claim 1 in which the copolymer is a block copolymer of styrene and ethylene butylene.

4. A closure device as defined in claim 1 in which the elastomer is a copolymer of ethylene and propylene.

5. A closure device as defined in claim 1 in which the copolymer is about 40 to 80 wt. % of the blend and polypropylene is about 20 to 60 wt. % of the blend.

6. A closure device as defined in claim 1 in which the blend is about 60% of the copolymer and about 40% of polypropylene.

7. A method of lining a polyethylene closure having a top closure with an inner wall and an outer wall so that the lining can be removed, the method comprising:

lining by compression molding, the inner wall of the closure top with an elastomeric removable liner that is a blend of polypropylene and a copolymer of styrene and a copolymerizable monomer.

8. A method as defined in claim 7 in which the blend also contains mineral oil or petroleum oil.

* * * * *